US006540529B1

(12) United States Patent
Yu

(10) Patent No.: US 6,540,529 B1
(45) Date of Patent: Apr. 1, 2003

(54) ELECTRICAL CONNECTOR ASSEMBLY

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/138,437

(22) Filed: May 2, 2002

(30) Foreign Application Priority Data

Jan. 16, 2002 (TW) ..... 91200312 U

(51) Int. Cl.[7] ..... H01R 12/00

(52) U.S. Cl. ..... 439/74; 439/65; 439/292; 439/284; 439/660; 439/680

(58) Field of Search ..... 439/65, 74, 660, 439/680, 290, 284, 292

(56) References Cited

U.S. PATENT DOCUMENTS 6,162,081 A * 12/2000 Commerci et al. ..... 439/287

6,190,192 B1 * 2/2001 White et al. ..... 439/292

* cited by examiner

*Primary Examiner*—Tho D. Ta
*Assistant Examiner*—Truc Nguyen

(57) ABSTRACT

An electrical connector assembly (1) has first and second electrical connectors (10) mated with each other. Both connectors have an identical configuration. Each connector comprises an insulating housing (11) and a plurality of identical terminals (12) received in the insulating housing. The insulating housing comprises a base portion (111), a first and second side walls (112, 113) extending upwardly from opposite lateral sides of the base portion. The second side wall defines a slot (1130) dimensioned corresponding to the first side wall. The first side wall of one of the two electrical connectors is inserted into the slot of the other electrical connector. Each terminal has a mating portion (123) comprising a first curved portion (1231) and a second curved portion (1232). The first and second curved portions of one electrical connector engage with the second and the first curved portions of the other electrical connector.

1 Claim, 5 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly having a pair of identical electrical connectors mating with each other.

2. Description of Related Art

Referring to FIG. 7, a conventional electrical connector assembly comprises a female connector 5 and a male connector 6. The female connector 5 comprises an insulating housing 51 and a plurality of female terminals (not shown) received in the insulating housing 51. The male connector 6 comprises an insulating housing 61 and a plurality of pin-like male terminals 62. The male terminals 62 are received in the female terminals of the female connector 5 and electrically connected with therewith, when the two connectors mate with each other. The female terminals each are deflected to clamp a corresponding male terminal 62.

Because the male terminals 62 and the female terminals have different configurations, two different dies are needed to stamp the male terminals 62 and the female terminals. Two different molds are also needed to form the insulating housings 51, 61. The different dies and molds complicate the process and increase the cost for manufacturing the connector assembly. Furthermore, because the male and female connectors 6, 5 have different configurations, they cannot be interchangeably used. This further increases the inventory cost.

U.S. Pat. No. 5,498,167 discloses an electrical interconnection system. A first electrical connector is used to mate with a second electrical connector having an identical structure with the first electrical connector. Each connector includes a housing mounted with a plurality of stamped female and male terminals. A contact post of the male terminal is received into opposed contact arms of the female terminal. The connectors of this prior art still have a complicate structure and need two different types of terminals.

U.S. Pat. No. 5,098,311 discloses an electrical interconnection system in which both the housing and the contacts of each connector are hermaphroditic without gender limitations. The two housings are easily to disconnect with each other because there is no securing means formed thereon to prevent the two housings from moving away from each other. Thus, an improved electrical connector assembly is needed to solve the problems above mentioned.

SUMMARY OF THE INVENTION

Accordingly, an object of the present invention is to provide a cost-effective and interchangeable electrical connector assembly.

In order to achieve the object set forth, an electrical connector assembly in accordance with the present invention has two identical electrical connectors mated with each other. Each connector comprises an insulating housing and a plurality of identical terminals received in the insulating housing. The insulating housing comprises a base portion, a first and second side walls extending upwardly from opposite lateral sides of the base portion. The base portion together with the first and second side walls define a receiving space. The second side wall defines a slot dimensioned corresponding to the first side wall. The first side wall of one of the two electrical connectors is inserted into the slot of the other electrical connector. Each terminal has a mating portion received in the receiving space. The mating portion comprises a first and a second curved portions. The first and second curved portions of one electrical connector engage with the second and the first curved portions of the other electrical connector.

Other objects, advantages and novel features of the invention will become more apparent from the following detailed description when taken in conjunction with the accompanying drawings.

DETAILED DESCRIPTION OF THE INVENTION

Figure 1:
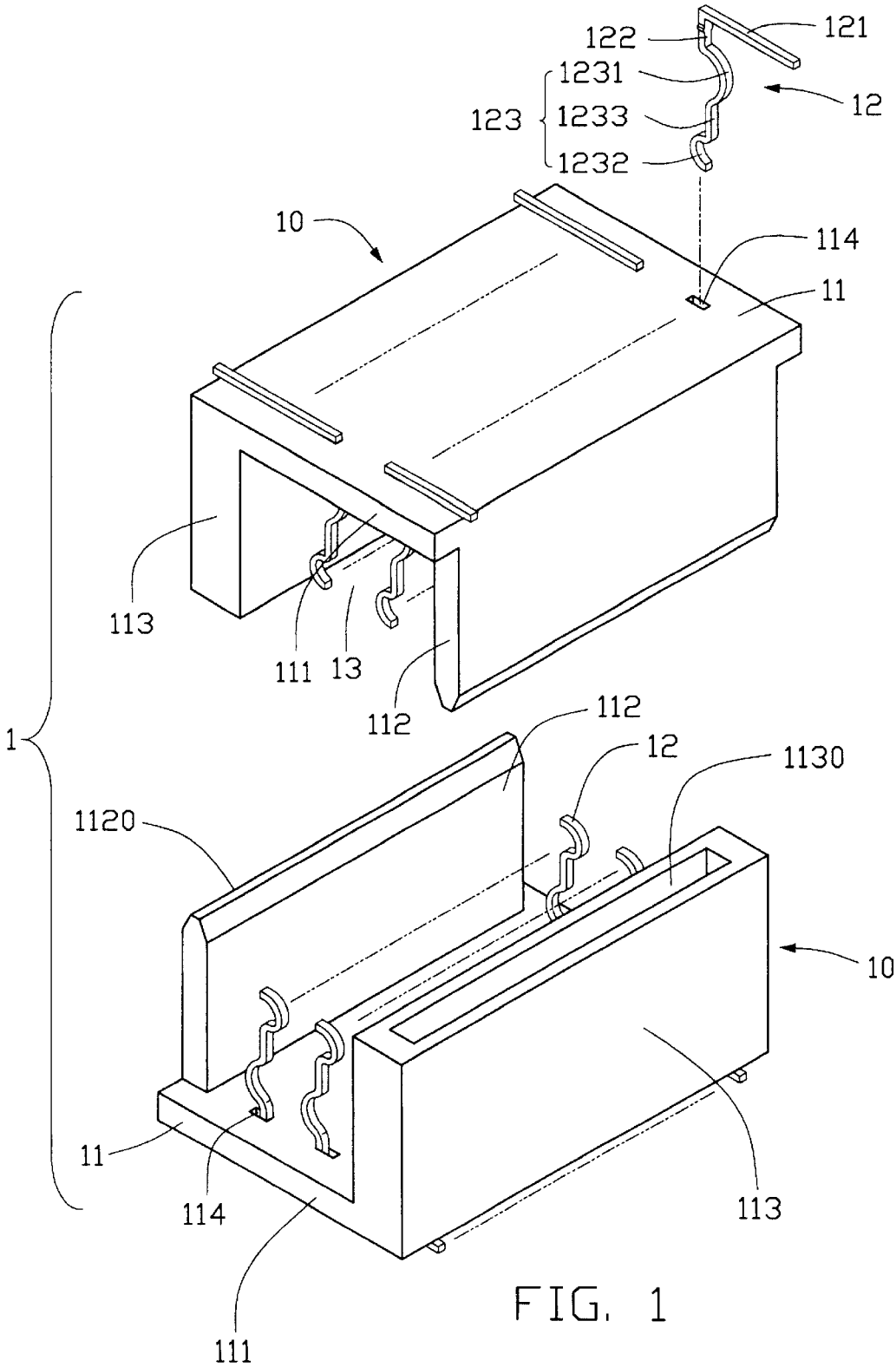
FIG. 1 is an exploded perspective view of an electrical connector assembly in accordance with the present invention.
Figure 2:
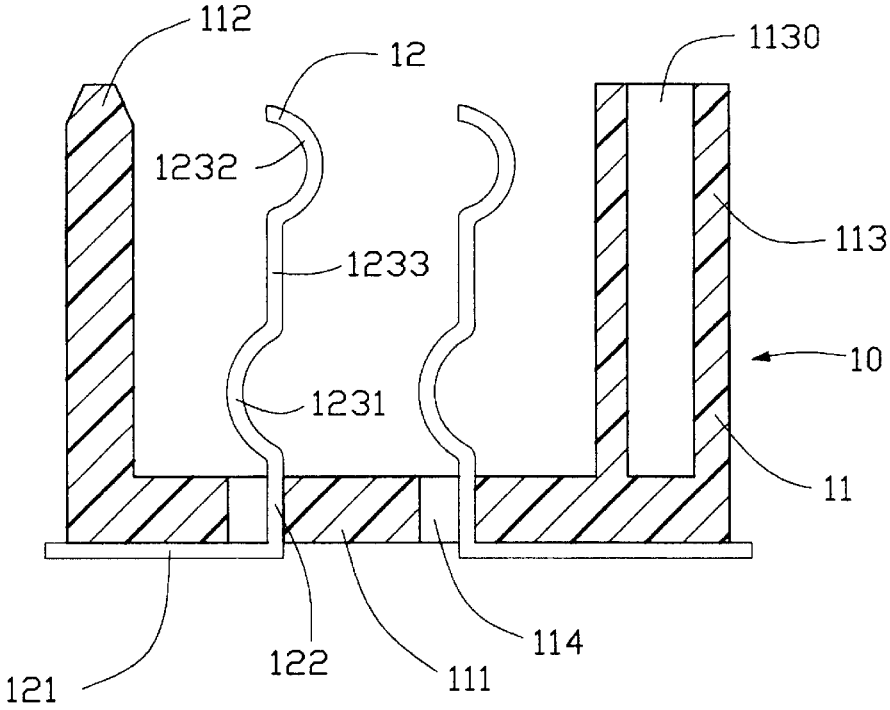
FIG. 2 is a cross-sectional view of an electrical connector shown in FIG. 1.

Referring to FIGS. 1 and 2, a hermaphroditic electrical connector assembly 1 in accordance with a first embodiment of the present invention comprises two identical electrical connectors 10 adapted to mate with each other. Each electrical connector 10 comprises an insulating housing 11 and a plurality of terminals 12. The insulating housing 11 is molded of plastic material and comprises a base portion 111, first and second side walls 112, 113 extending vertically from opposite lateral sides of the base portion 111. The base portion 111 together with the first and second side walls 112, 113 defines a receiving space 13 therebetween. The base portion 111 defines two longitudinal rows of terminal receiving holes 114 between the side walls 112, 113 for receiving the plurality of terminals 12. The second side wall 113 is thicker than the first side wall 112 and defines an elongated slot 1130 dimensioned corresponding to the first side wall 112. The slot 1130 has a length and width substantially equal to those of the first side wall 112, and a depth substantially equal to a height of the first side wall 112. The first side wall 112 has a taped top end 1120.

The terminals 12 are formed by stamping a metal sheet and each comprise a retaining portion 122, a solder portion 121 perpendicularly extending from a lower end of the retaining portion 122 and a mating portion 123 extending from an upper end of the retaining portion 122. The mating portion 123 is generally "S" shaped and comprises a first curved portion 1231, a second curved portion 1232 and a linear connecting portion 1233 between the first curved portion 1231 and the second curved portion 1232. The first and second curved portions 1231, 1232 face opposite directions, respectively.

Figure 3:
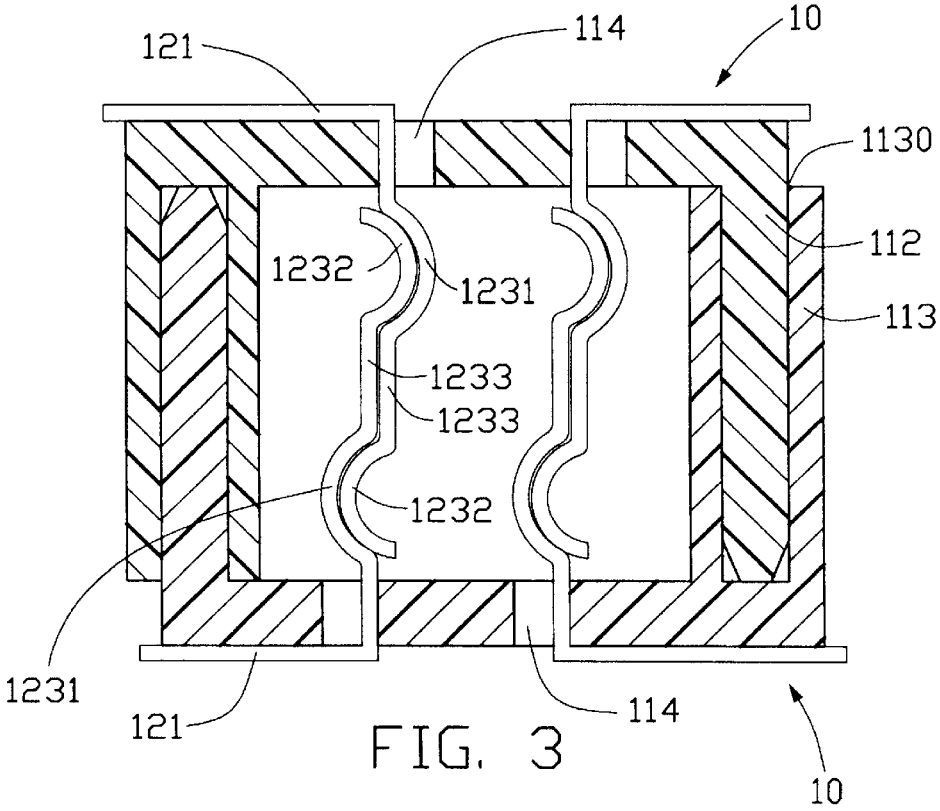
FIG. 3 is an assembled cross-sectional view of the electrical connector assembly of FIG. 1.

Further referring to FIG. 3, in assembly, each terminal 12 is secured in the housing 11 by the retaining portion 122 retained in the terminal receiving hole 114. The solder portion 121 extends beyond the base portion 111 for soldering to a printed circuit board (PCB) (not shown) by surface mounting technology. The mating portion 123 extends into the receiving space 13. when the two electrical connectors 10 mates with each other, the first side wall 112 of one electrical connector 10 is inserted into the slot 1130 of the other electrical connector 10 for securing the two electrical connectors 10 together and preventing the two connectors 10 from moving away from each other in a horizontal direction. The terminals 12 separately assembled in the two electrical connectors are electrically connected with each other by the first and second curved portions 1231, 1232 of the other electrical connector engaging with the second and the first curved portions 1232, 1231 of the one electrical connector 10. The engagement between the terminals 12 in the two electrical connectors 10 prevents the two electrical connectors 10 from separating from each other in a vertical direction.

Figure 4:
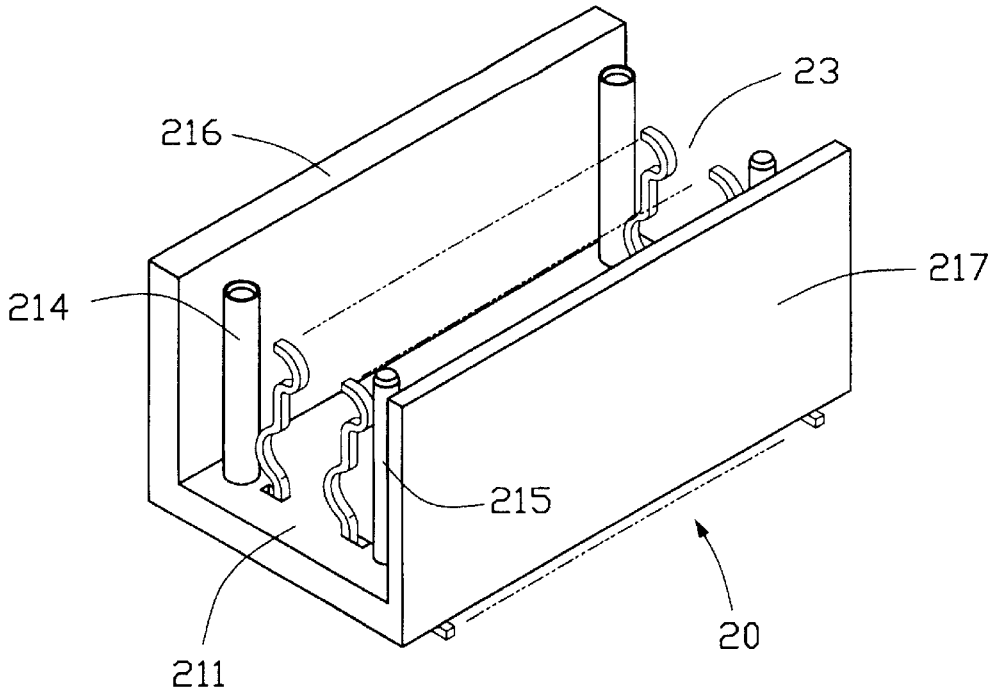
FIG. 4 is a perspective view of an electrical connector of an electrical connector assembly in accordance with a second embodiment of the present invention.
Figure 5:
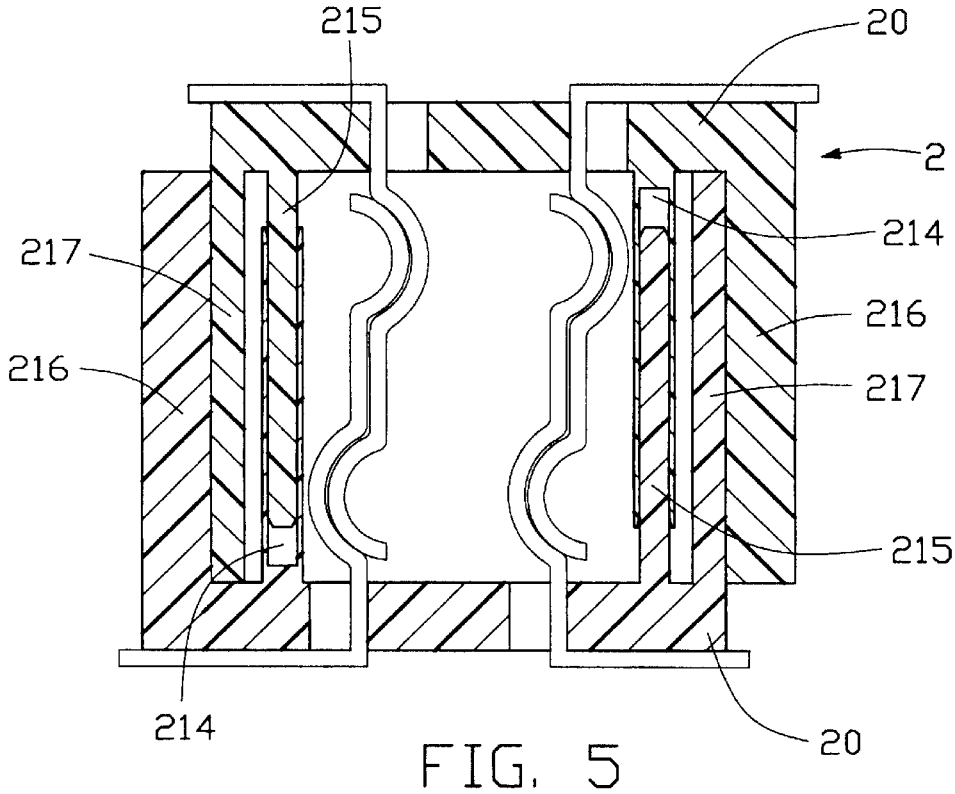
FIG. 5 is an assembled cross-sectional view of the electrical connector assembly in accordance with the second embodiment.

Referring to FIGS. 4 and 5, an electrical connector assembly 2 in accordance with a second embodiment of the present invention comprises two electrical connectors 20. Each electrical connector 20 comprises a pair of hollow posts 214 and a pair of poles 215 respectively extending from opposite lateral sides of the base portion 211 into a receiving space 23. A thick wall 216 and a thin wall 217 vertically extend upwardly form the lateral sides of the base portion 211, in which the thick wall 216 is located outside and near the posts 214 and the thin wall 217 is located outside and near the poles 215.

In assembly, the poles 215 of one electrical connector 20 are inserted into the hollow posts 214 of the other electrical connector 20, and the thin walls 217 abut against inner sides of the thick walls 216, thereby preventing the two connectors from separating from each other in the horizontal direction. The connectors 20 each have terminals arranged in two longitudinal rows in the receiving space 23. Each terminal has a structure the same as that of the terminal 12 of the first embodiment.

Figure 6:
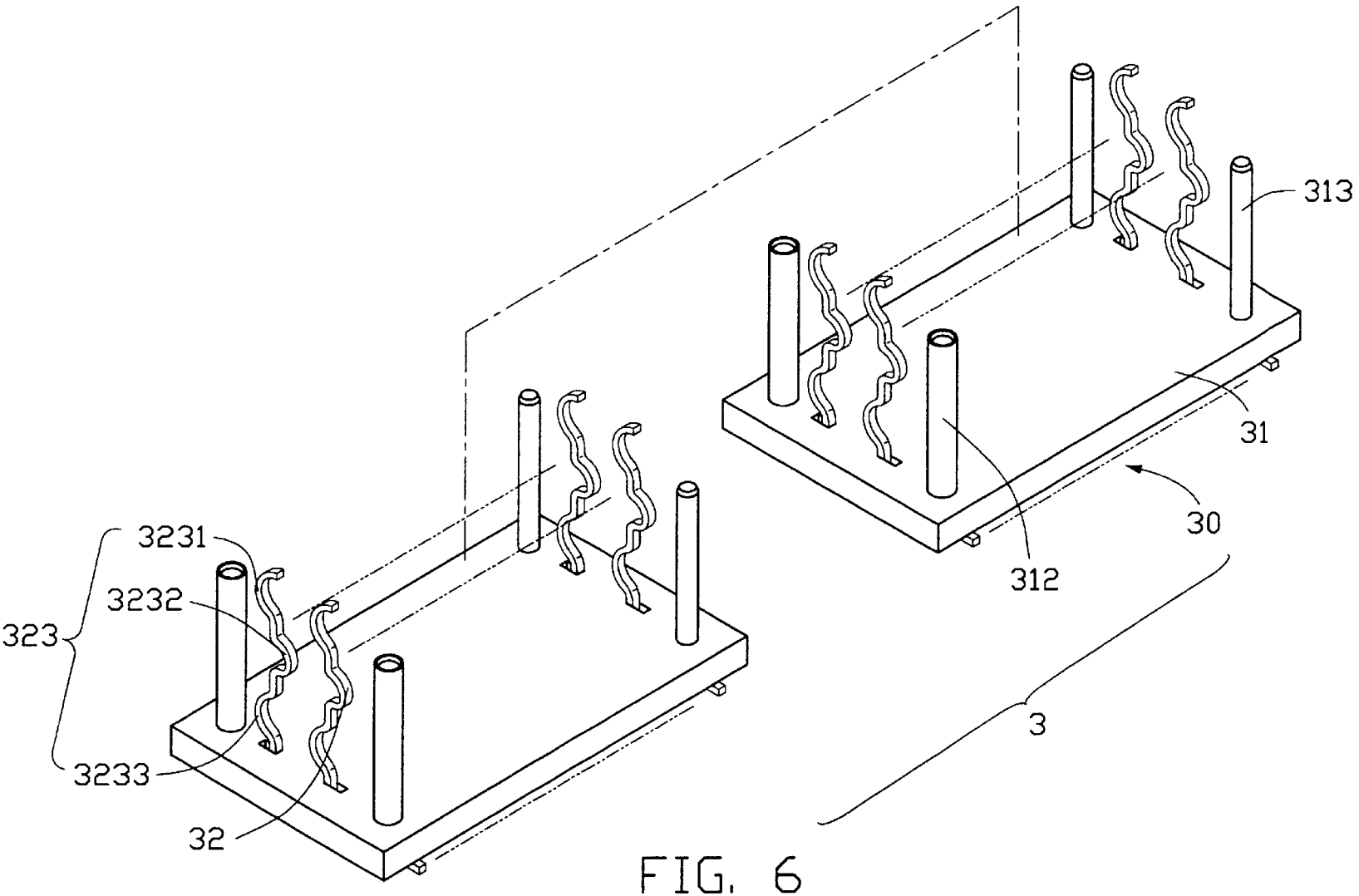
FIG. 6 is an exploded perspective view of an electrical connector assembly in accordance with a third embodiment of the present invention.
Figure 7:
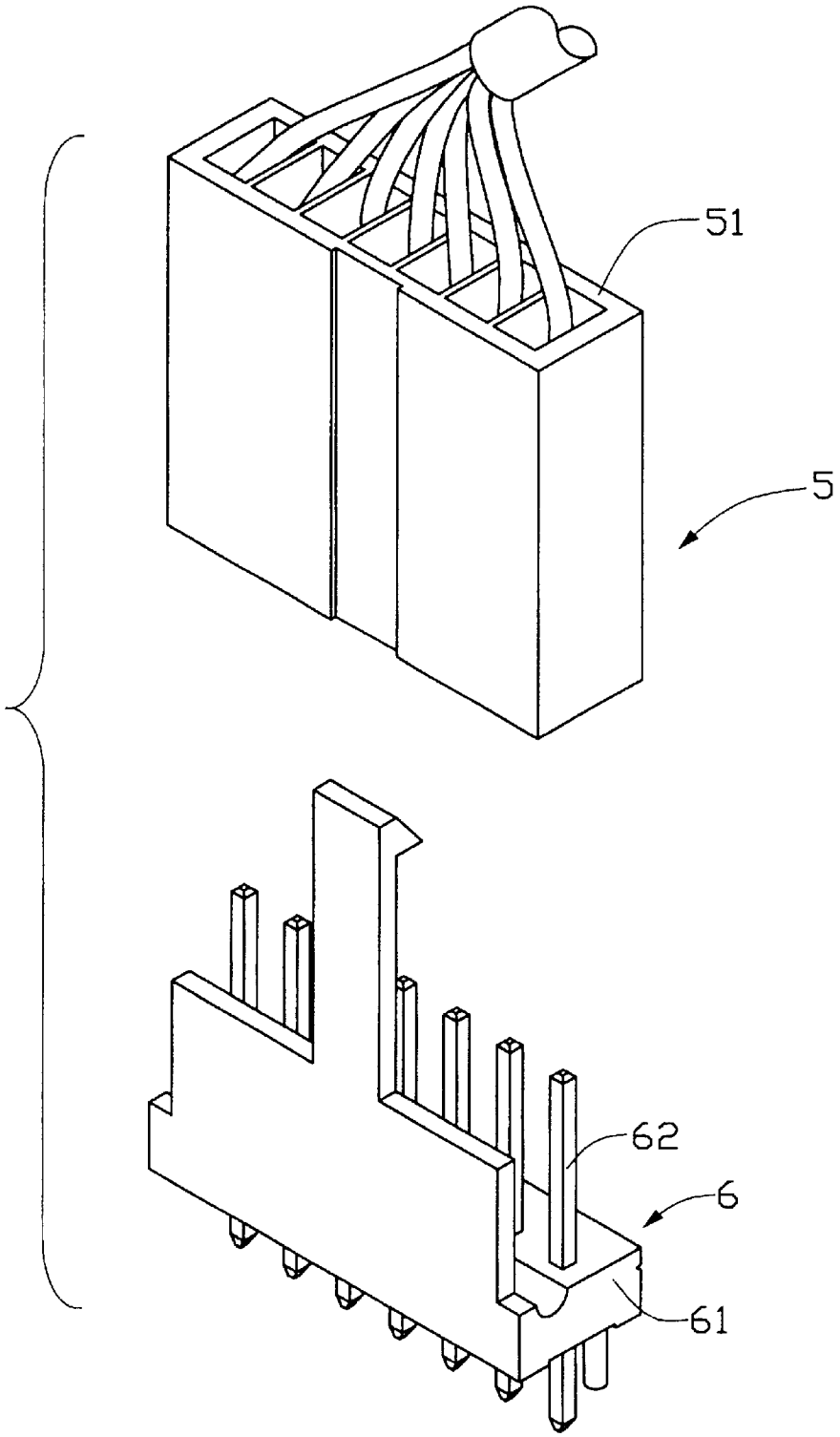
FIG. 7 (PRIOR ART)
FIG. 7 is perspective view of a conventional electrical connector assembly.

Referring to FIG. 6, an electrical connector assembly 3 in accordance with a third embodiment of the present invention comprises two electrical connectors 30. Each electrical connector comprises a base portion 31 and two rows of terminals 32. A pair of hollow posts 312 and a pair of poles 313 separately extend vertically from a pair of ends of the base portion 31. Each terminal 32 has a mating portion 323 extending in a same direction as the hollow posts 312 and the poles 313. The mating portion 323 comprises three curved portions in turn, named the first, the second, and the third curved portions 3231, 3232, 3233 respectively. The first and third curved portion 3231, 3233 are bent to a first direction and the second curved portion is bent to a second direction opposite to the first direction. In assembly, the pair of poles 313 of one electrical connector 30 are inserted into the pair of hollow posts 312 of the other electrical connector 30. The first, the second, and the third curved portions 3231, 3232, 3233 of one electrical connector 30 are engaged with engaged with the third, the second and the first curved portions 3233, 3232, 3231 of the other electrical connector 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hermaphroditic connector assembly having first and second connectors mating with each other and the two connectors having identical configurations, each of the two connectors comprising an insulating housing and a plurality of identical terminals received in the insulating housing, each terminal comprising a retaining portion, a solder portion perpendicularly extending from a first end of the retaining portion and a mating portion extending from a second end of the retaining portion, the mating portion having a first curved portion and a second curved portion being bent in an opposite direction, the first and second curved portions of one of the two connectors being engaged with the second and first curved portions of the other connector for securing an electrical connection between the two connectors, wherein the insulating housing comprise a base portion, a male and a female side walls extending from opposite lateral sides of the base portion, the base portion together with the male and female walls defining a receiving space, the matting portion of the terminals being received in the receiving space, the female side wall defining an elongated slot dimensioned corresponding to the male side wall, the male side wall of one of the two connectors being received in the slot of the female side wall of the other connector; and wherein the base portion having a pair of hollow posts and a pair of poles extending therefrom, the poles of one of the two connectors being inserted into the hollow posts of the other connector.

* * * * *